US011246420B1

(12) United States Patent
Marquez

(10) Patent No.: US 11,246,420 B1
(45) Date of Patent: Feb. 15, 2022

(54) ADJUSTABLE LUMBAR SUPPORT

(71) Applicant: Ashley Furniture Industries, LLC, Arcadia, WI (US)

(72) Inventor: Rigoberto Marquez, New Albany, MS (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 0 days.

(21) Appl. No.: 16/806,983

(22) Filed: Mar. 2, 2020

Related U.S. Application Data

(60) Provisional application No. 62/812,759, filed on Mar. 1, 2019.

(51) Int. Cl.
*A47C 7/46* (2006.01)

(52) U.S. Cl.
CPC ..... *A47C 7/462* (2013.01)

(58) Field of Classification Search
CPC ..... A47C 7/462; B60N 2/6673
USPC ..... 297/284.4
See application file for complete search history.

(56) References Cited

U.S. PATENT DOCUMENTS 3,807,794 A 4/1974 Beyer
4,182,533 A 1/1980 Arndt et al.
4,295,681 A * 10/1981 Gregory ..... A47C 7/462 297/284.4
4,313,637 A * 2/1982 Barley ..... B60N 2/66 297/284.4
4,449,751 A * 5/1984 Murphy ..... B60N 2/66 297/284.4
4,896,918 A * 1/1990 Hoshihara ..... A47C 7/462 297/284.4
5,088,790 A 2/1992 Wainwright et al.
5,403,069 A * 4/1995 Inara ..... A47C 7/462 297/284.4
5,588,703 A 12/1996 Itou
5,947,558 A 9/1999 Suzuki et al.
9,826,841 B2 * 11/2017 Donovan ..... A47C 7/462
10,085,564 B2 * 10/2018 Bullard ..... A47C 7/462
10,130,185 B2 * 11/2018 Sigmon ..... A47C 7/462
10,660,441 B2 * 5/2020 Ma ..... A47C 1/034
2006/0103204 A1 5/2006 Walker et al.
2007/0106188 A1 5/2007 Walker
2009/0079245 A1 * 3/2009 Marcantoni ..... A47C 7/465 297/284.4
2013/0145553 A1 * 6/2013 Shih ..... A47C 7/462 5/624
2013/0334854 A1 12/2013 LaPointe et al.
2014/0070583 A1 3/2014 McMillen et al.
2017/0181549 A1 * 6/2017 Donovan ..... B60N 2/66
2018/0064254 A1 3/2018 Donovan et al.
2020/0054140 A1 * 2/2020 Fei ..... A47C 7/38
2020/0138198 A1 * 5/2020 Bucholz ..... A47C 7/462

* cited by examiner

*Primary Examiner* — Rodney B White
(74) *Attorney, Agent, or Firm* — Christensen, Fonder, Dardi & Herbert PLLC

(57) ABSTRACT

An adjustable lumbar support system for a chair having a single swing bar. An actuator is mounted between the lumbar support base and the chair frame and may be motorized. Extending the extension shaft of the actuator provides additional support to a user seated in the chair.

18 Claims, 6 Drawing Sheets

ADJUSTABLE LUMBAR SUPPORT

CROSS-REFERENCE TO RELATED APPLICATION

This application claims the benefit of U.S. Provisional Application No. 62/812,759, filed Mar. 1, 2019, the disclosure of which is hereby incorporated by reference in its entirety.

FIELD OF THE INVENTION

The present invention relates to lumbar support mechanisms and more specifically to adjustable lumbar support mechanisms in reclining chairs. Even more specifically, the present invention is directed to a lumbar support mechanism having a single swing bar. This invention further relates to sofas, love seats, sectionals, traditional chairs, and other furniture that would benefit from an improved lumbar support mechanism.

BACKGROUND OF THE INVENTION

Reclining chairs are designed to support the human body in a variety of positions. Comfort and support are particularly important. Lack of support in a chair can create a great deal of stress on the lower back. In a seated position, lumbosacral discs in the spine are loaded significantly more than in a standing position. The lower portion of the spine is naturally curved inward, just above the pelvic region, towards the belly button before resuming an outward curve as the spine approaches the neck. This inward curve, also known as the lumbar curve, creates a gap between a seated user's spine and the back of the chair, leaving the spine unsupported. Lack of spine support causes the large muscles in the lower back to be overworked, causing muscle fatigue. Fatigued muscles, in turn, lead to poor posture and a variety of ancillary complications through the upper back and neck.

Recliners with adjustable lumbar supports are known, see for example, U.S. Pat. Nos. 4,313,637 and 10,368,646. In that residential furniture consumers are highly cognizant of value and cost, any advancements in the simplicity of mechanisms that are reflected in lower cost, particularly where the reliability and robustness of the mechanism is not detrimentally effected, would be welcomed by the consuming public and the furniture manufacturing industry.

SUMMARY OF THE INVENTION

According to an embodiment of the present invention, an adjustable lumbar support system for altering the position of a lumbar support in a piece of furniture, such as a seat back with a seat back frame having a left side, a right side, a front side, and a back side, includes a cross bar secured to the seat back frame and extending between the left and right sides of the seat back frame. A bracket system providing two or more pivot axis points is mounted to the cross bar. A lumbar support base with a front surface opposite a back surface, the front surface facing the front side of the seat back frame, is fixedly attached to a bottom portion of a single swing arm having an "L" shape. A top portion of the swing arm is pivotally coupled a first pivot point of the bracket system. An actuator system with an extendable shaft has a first end portion pivotally coupled to a second pivot point of the bracket system and a second portion pivotally coupled to the bottom portion of the single swing arm, the first end portion being opposite the second end portion. Extending the extendable shaft of the actuator system pushes the lumbar support base towards the front side of the seat back frame.

In embodiments, the top portion of the single swing arm includes one or more knuckles. In embodiments, in a pin passing through the one or more knuckles and the bracket system defines an axis about which the single swing arm rotates. In embodiments, the bracket system includes a pair of brackets. In embodiments, each of the pair of brackets defines a notch generally conforming to the cross bar. In embodiments, each of the pair of brackets includes a stop which limits the rotation of the single swing arm towards the back side of the seat back frame. In embodiments, the pair of brackets are spaced apart such that a pair of knuckles can surround the pair of brackets and the first end portion of the actuator system fits within the pair of brackets.

In embodiments, a first pin passes through the each of the pair of and knuckles and the pair of brackets at a first of the two or more pivot points, and a second pin passes through the first end portion of the actuator system and the pair of brackets. In embodiments, the first pin is farther from the back side of the seat back frame than the cross bar, and the second pin is generally the same distance from the back side of the seat back frame as the cross bar.

In embodiments, the bottom portion of the single swing arm has one or more lower knuckles having a connecting portion extending towards the back side of the seat back frame. In embodiments, a lower pin passes through the one or more lower knuckles and the second portion of the actuator system defines a lower axis of rotation, the lower axis of rotation being generally parallel to the cross bar. In embodiments, the one or more lower knuckles has a mounting portion opposite the connecting portion. In embodiments, the mounting portion of the one or more lower knuckles defines one or more notches configured to interface with corresponding slots in the lumbar support base such that support base is generally flush with the single swing arm when mounted.

In embodiments, the support base is welded to the single swing arm. In embodiments, the support base defines a plurality of through holes configured to receive mounting bolts. In embodiments, the actuator system is motorized. In embodiments, a motor fits within the seat back frame. The motor is optimally located and tucked behind the lumbar plate.

A feature and advantage of embodiments a swing arm assembly that is only four inches or less in width and that is centrally positioned in a recliner frame and engages a back side of a lumbar support base or plate at the middle of said base or plate.

According to embodiments, a seating unit for providing adjustable lower spine support includes a seat back extending upwardly from a seat base. The seat back has a seat back frame having a right side, a left side, a front side facing the seat base, and a rear side opposite the front side. The seating unit further includes a lumbar support system configured to adjust the position of a lumbar support base. The lumbar support system includes a cross bar extending between the left and right sides of the seat back frame. A pair of brackets mounted are to the cross bar. Each of the pair of brackets has first and second pivot points. A single swing arm is pivotally coupled to the first pivot point of each of the pair of brackets. A bottom portion of the single swing arm is fixedly attached to the lumbar support base. An actuator system with an extendable shaft and a mechanical extender is pivotally coupled to the single swing arm and the pair of brackets. The actuator system has a first end portion opposite a second end portion. The first end portion is pivotally coupled to the second pivot point of each of the pair of brackets. The second portion pivotally coupled to the bottom portion of the single swing arm. Extending the extendable shaft of the actuator system pushes the lumbar support base towards the front side of the seat back frame. In embodiments, the mechanical extender is motorized. In embodiments, the cross bar is a metal tube.

A feature and advantage of embodiments is a simple design with a minimal number of moving parts. Reduction in the number of moving parts offers numerous advantages. For example, using less parts reduces manufacturing costs while improving manufacturing speed. Fewer parts also results in fewer errors during manufacture. Further, the improved design is less prone to breakage. Increasing the number of pivot locations or mounting locations can dramatically increase the likelihood of mechanical failure. For example, a pivot point might slip causing the system to jam or otherwise not move in a uniform fashion. Likewise any damage to one side of the system, like a bent arm, bracket, or loose connector, might cause the system to jam or otherwise not move in a uniform fashion. Having the lumbar support move such that the left or right edge extends farther than the opposite edge would create an unpleasant experience for the user. Similarly, having the lumbar support stuck in a particular position may be uncomfortable and for that reason render the entire article of furniture useless.

The inventor has discovered that a centrally positioned swing arm with a centrally positioned actuator provides an adequate and robust mechanism for an adjustable lumbar support. The simplicity of the mechanism are reflected in lower cost to manufacture and install while providing equal or greater reliability and robustness compared to prior art mechanisms.

DETAILED DESCRIPTION OF THE PREFERRED EMBODIMENTS

Figure 1B:
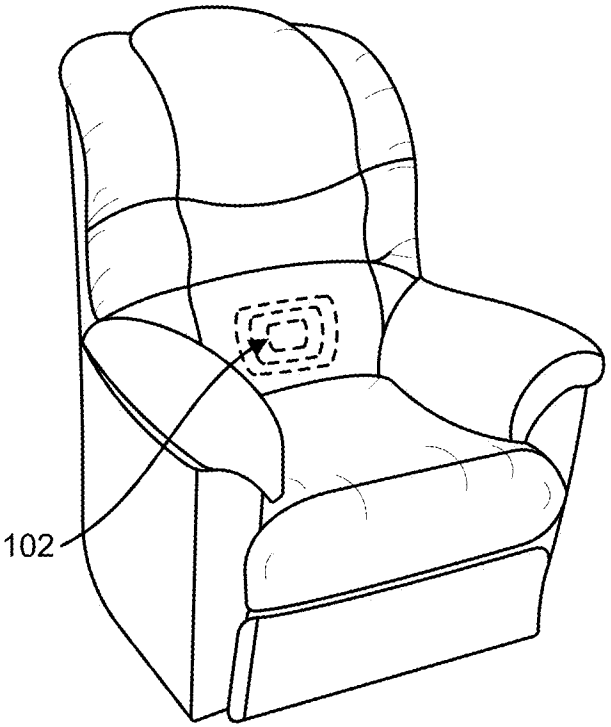
FIG. 1B is a perspective view of an upholstered chair with an adjustable lumbar support in an extended position.
Figure 1A:
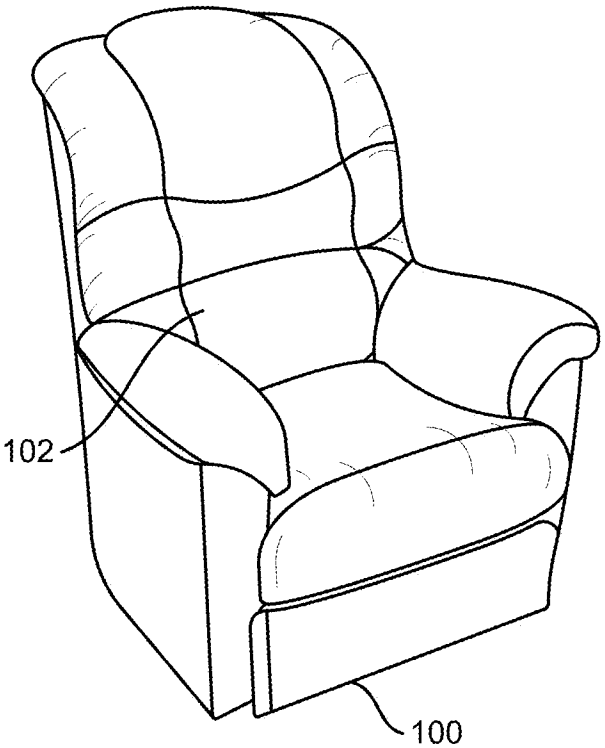
FIG. 1A is a perspective view of an upholstered chair with an adjustable lumbar support in a retracted position.

FIG. 1A is a perspective view of an upholstered chair 100 with an adjustable lumbar support without the adjustable lumbar support extended. In this embodiment, the lumbar region 102 is unextended. FIG. 1B is a perspective view of an upholstered chair 100 with an adjustable lumbar support. In this embodiment, the adjustable lumbar support is extended. When the adjustable lumbar support is extended, lumbar region 102 is pressed outward, moving away from the chair and toward a seated user.

Figure 2A:
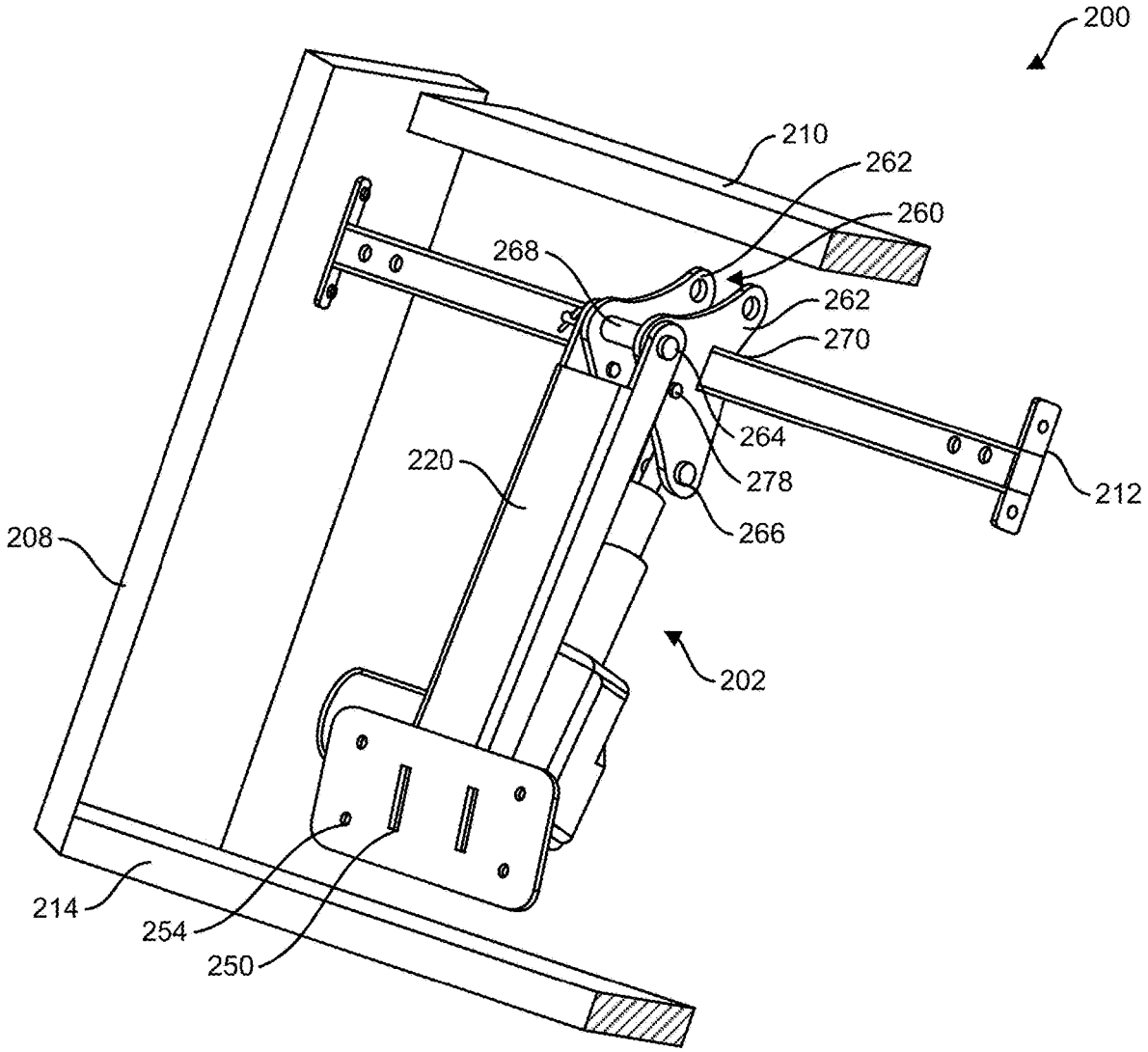
FIG. 2A is a perspective front view of an adjustable lumbar mechanism.
Figure 2B:
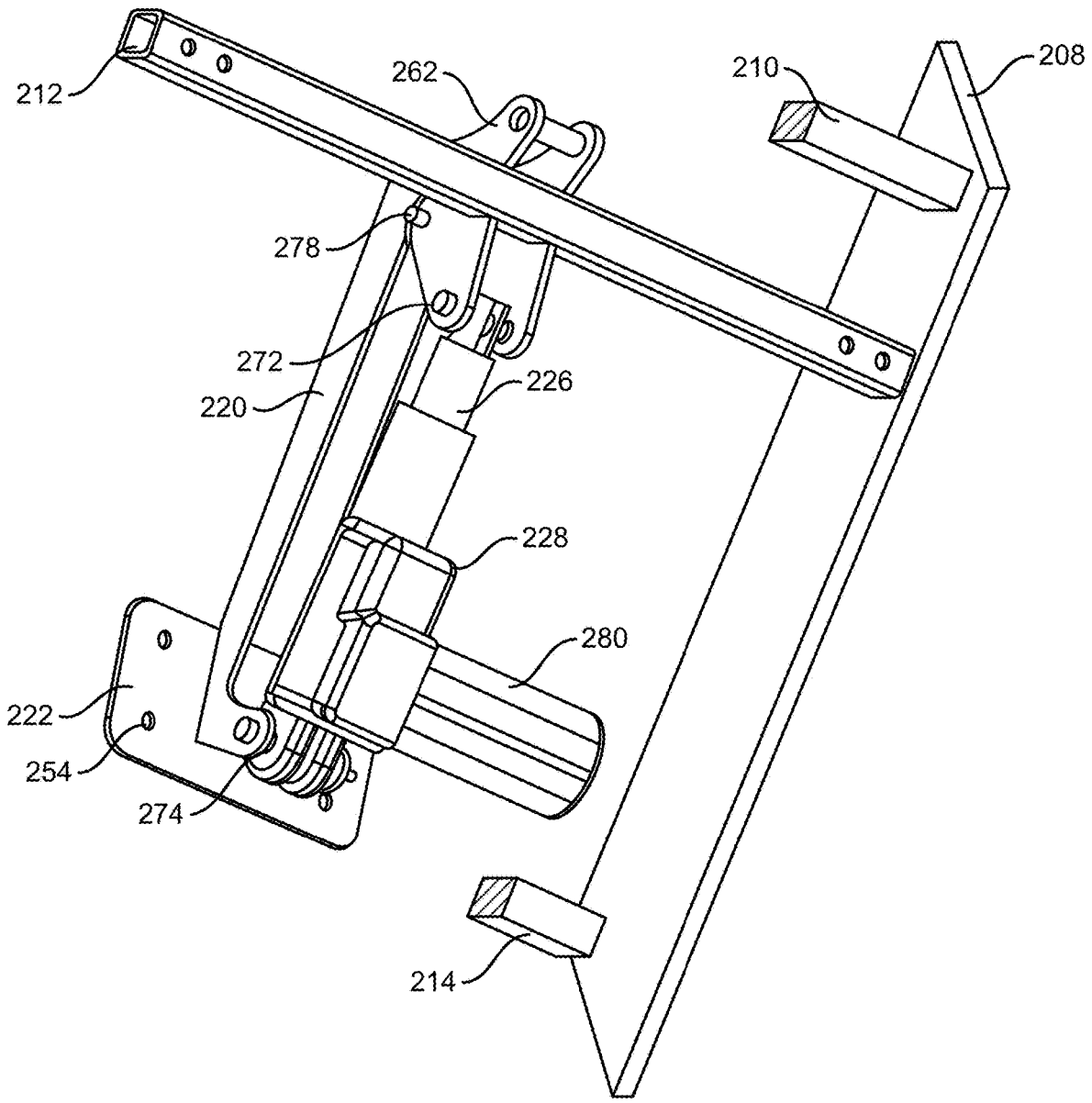
FIG. 2B is a perspective rear view of an adjustable lumbar mechanism.
Figure 2E:
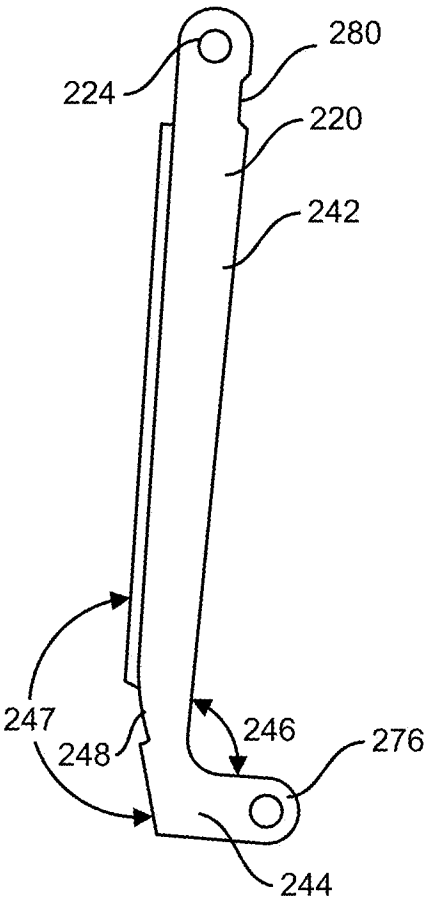
FIG. 2E is a side view of a swing arm.
Figure 2D:
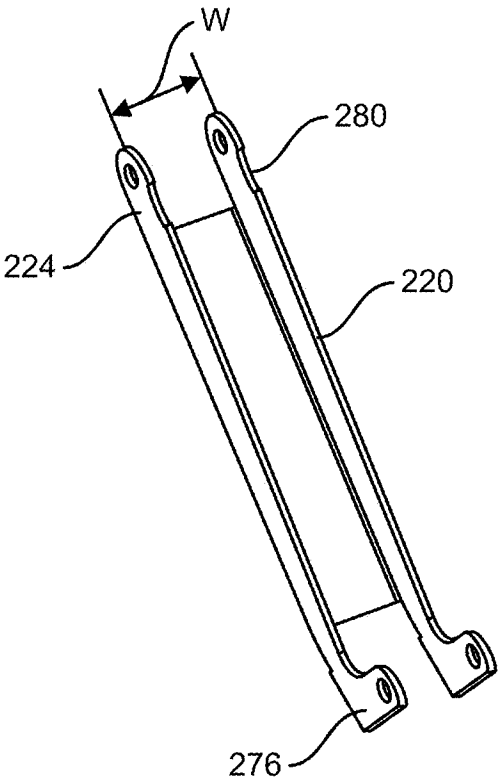
FIG. 2D is a perspective rear view of a swing arm.
Figure 2C:
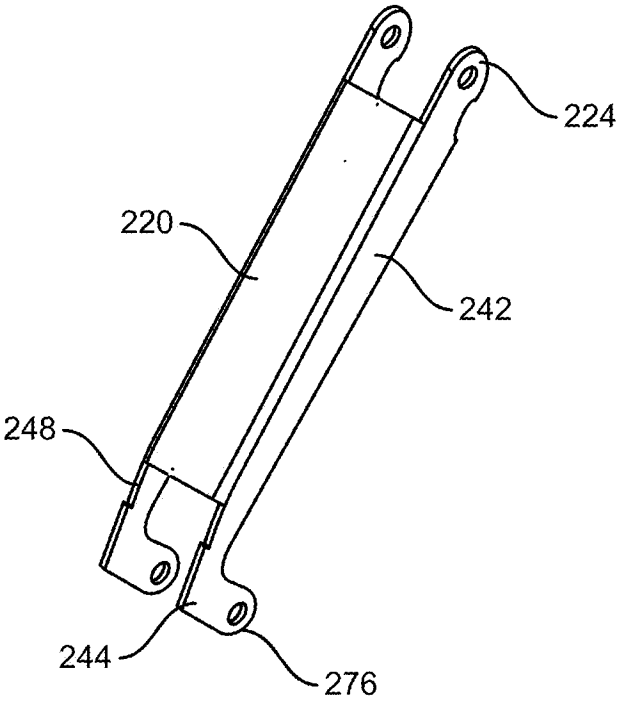
FIG. 2C is a perspective front view of a swing arm.

Referring to FIGS. 2A-2E, adjustable lumbar mechanism 200 includes actuator 202, and lumbar support 204. Lumbar support 204 includes a single swing arm 220, and a support base 222. Swing arm 220 is generally "L" shaped, having a long leg 242 and a short leg 244. A top portion of swing arm 220, near a distal end of long leg 242, one or more knuckles 224. A bottom portion of swing arm 220, including short leg 244, has one or more knuckles 276. In embodiments, long leg 242 and short leg 244 are generally perpendicular to one another. In embodiments, inner and outer edges of long leg 242 and short leg 244 may have different angles. For example, as illustrated in FIG. 2E, inner edges of long leg 242 and short leg 244 may meet at right angle 246 while outer edges of long leg 242 and short leg 244 may meet at angle 247 which is greater than ninety degrees. Having an angle greater than ninety degrees advantageously directs support base 222 away from a seated user so that in the fully retracted position, there is minimal contact between a user and adjustable lumbar mechanism 222.

A bottom portion of swing arm 220 is fixedly attached to the support base 222. Swing arm has one or more notches 248 corresponding one or more centrally located slots 250 in support base 222. Swing arm 220 may be aligned with support base 222 such that an outward facing surface 252 of support base 222 is generally flush with swing arm 220. In embodiments, a bottom portion of swing arm 220 may be fixedly attached to support base 222 through means such as welds, bolts, screws, glue, or the like. In embodiments, swing arm 220 and support base 222 may be uniform and stamped or molded in the desired shape. The adjustable lumbar support 204 comprises rigid, non-flexible materials such as metal, steel, wood, aluminum, or the like. The width W of the swing arm may be 4 inches or less in embodiments.

The adjustable lumbar mechanism 200 is attached to a chair frame 206 such as a recliner frame. In one example, as chair frame 206 includes a side support 208, and cross bars 210, 212, and 214. Cross bars 210, 212, and 214 are generally orthogonal to the side support 208 and securely attached thereupon through fastening mean such as screws, bolts, nails, glue, welds, or the like. In some embodiments, the cross bars 210, 212, and 214 are made of wood or wood based materials. In other embodiments, the cross bars 210, 212, and 214 are made of metal, steel, aluminum or the like. In yet another embodiment, the cross bars 210, 212, and 214 may be selected from different materials. For example, the cross bars 210 and 214 may be wood, while cross bar 212 may be steel. Cross bars 210, 212, and 214 may be solid. In embodiments, cross bars 210, 212, and 214 are tubular.

In embodiments, adjustable lumbar mechanism 200 is attached to cross bar 212 via bracket system 260. Bracket system 260 includes notch 270 and pivot apertures 264, 266 configured to receive pivot pins. Notch 270 generally conforms to cross bar 212. Bracket system 260 is permanently affixed to cross bar 212. For example, bracket system 260 may be welded to cross bar 212 along notch 270. In embodiments, bracket system 260 is a pair of brackets 262. Brackets 262 may be spaced apart such that knuckles 224 of swing arm 220 surround the pair of brackets 262 while at the same time telescoping arm 226 fits between pair of brackets 262. Bracket system 260 is oriented such that a first pivot aperture 264 is forward of cross bar 212 where the forward direction is towards the front of chair 100. A second pivot aperture 266 is below cross bar 212 where the downward direction is towards the seat of chair 100. Pivot pin 268 acts as a pin in a hinge and is slid through first pivot aperture 264 and conforming holes in knuckles 224, thereby allowing the swing arm 220 to rotate about an axis orthogonal to the side support 208. Pivot pin 272 acts as a pin in a hinge and is slid through second pivot aperture 266 and conforming holes in telescoping arm 226, thereby allowing the telescoping arm 226 to rotate about an axis orthogonal to the side support 208.

At the lower portion of swing arm 200, pivot pin 274 acts as a pin in a hinge and is slid through knuckles 276 and corresponding apertures in the bottom portion of actuator 202. As illustrated, adjustable lumbar mechanism 200 has three separate points of rotation. Two points of rotation are at pivot pins 268, 272 on bracket system 260, which in turn is permanently affixed to cross bar 212. As such, while rotation is possible about pivot pins 268, 272, these points are not free to move in space. Accordingly, rotation about pivot pins 268, 272 causes support base 222 to move either towards the front or the rear of chair 100. In the forward, or extended, direction, the distance to which support base 222 may protrude is inherently limited by the length of telescoping arm 226. One skilled in the art will recognize other means exist to limit the forward movement of support base 222. For example, actuator 202 may include internal mechanical stops. In embodiments, a controller system (not shown) may have a memory programmed to prevent the user from extending actuator 202 beyond a preset distance. In the rearward direction, towards the back of chair 100, stop 278 prevents swing arm 200 from rotating beyond a set point. In embodiments, stop 278 may be an outward extending protrusion from bracket 262. In embodiments, swing arm 220 may have one or more notches 280 configured to interface with stop 278.

Figure 3B:
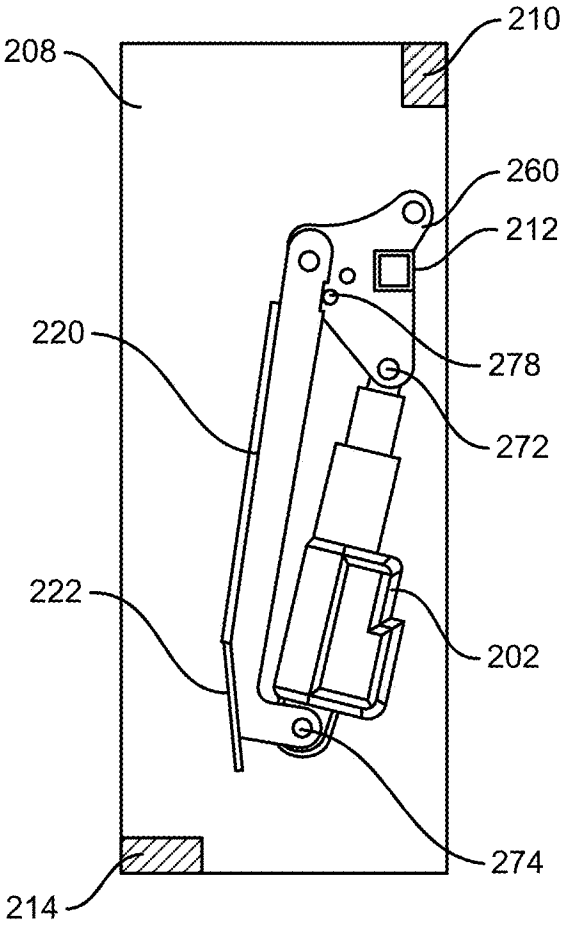
FIG. 3B is a side view of an adjustable lumbar mechanism.
Figure 3A:
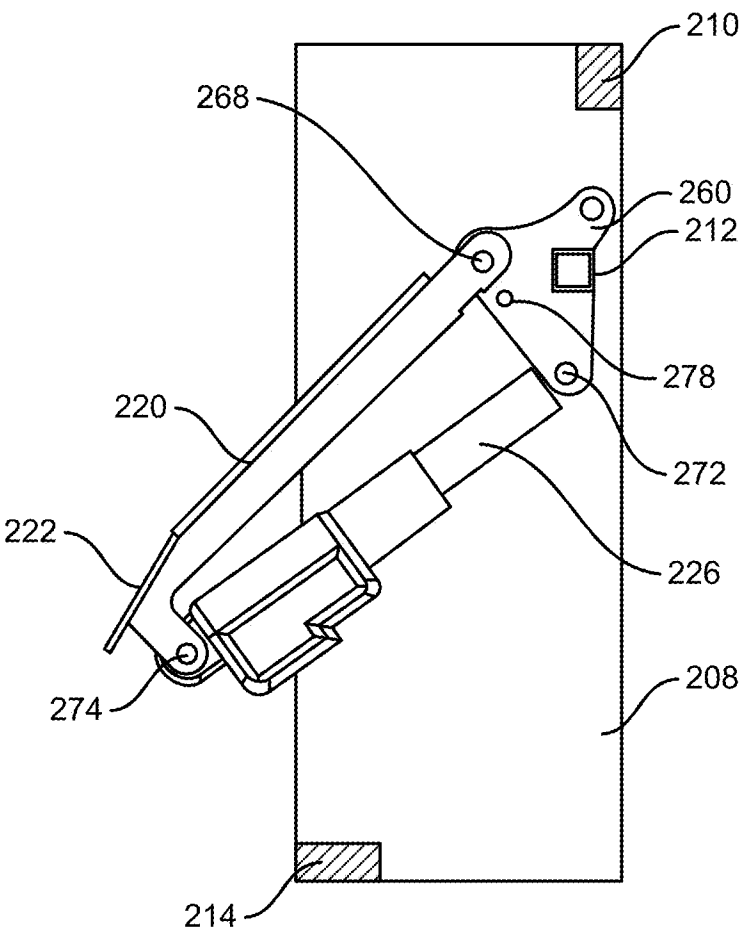
FIG. 3A is a side view of an extended adjustable lumbar mechanism.

FIG. 3A is a side plane view of an adjustable lumbar mechanism 200 in an extended position. FIG. 3B is a side plane view of an adjustable lumbar mechanism 200 in a retracted position. Actuator 202 includes a telescoping arm 226 and a mechanical extender 228 with an electric motor 280. Actuator 202 is attached to bracket system 260 at an actuator pivot 272. Actuator 202 is pivotally attached to the swing arm 200 at support pivot 274. In one embodiment, as depicted in FIGS. 4A and 4B, telescoping arm 226 is mounted to the swing arm 220 at support pivot 274 and the mechanical extender 228 is mounted to bracket system 260 at an actuator pivot 272. One skilled in the art will appreciate that this orientation may be reversed, such that the telescoping arm may be mounted to the swing arm 200 at support pivot 274 and the mechanical extender may be mounted to the bracket system 260 at actuator pivot 272, without altering the functionality of the actuator 202.

When the user activates the mechanical extender 228, the mechanical extender 228 actuates a telescoping arm 226. When the telescoping arm 226 is lengthened, the increased length of the telescoping arm 226 presses the support base 222 outward, in a direction away from the back of the chair frame 206 and towards a seated user. The amount of support provided to the lumbar area 102 is directly proportional to the increased length of the telescoping arm 226. When the telescoping arm 226 is shortened, the decreasing length of telescoping arm 226 pulls the support base 222 into the chair frame 206 and away from a seated user. In a fully retracted position, the support base 222 is located completely within the within the periphery of the chair frame 206.

In embodiments, a single adjustable lumbar mechanism 200 is attached to a chair frame 206. In other embodiments, a chair frame 206 may support multiple adjustable lumbar mechanisms. For example, in a love seat configuration supporting two users, a love seat frame may include two adjustable lumbar mechanisms providing each of the two users independent control over each of the adjustable lumbar mechanisms, thereby offering the ability for each user to adjust their respective adjustable lumbar mechanism according to their personal preferences.

In embodiments, the cross bars 210, 212, and 214 may be displaced vertically allowing for the support base 222 to be optimally positioned. In other embodiments, the width and height of the support base 222 may be varied to accommodate a variety of chair frames or users. In other embodiments, the support base 222 may be combined with other materials to enhance the user experience. For example, a steel support base 222 may be joined with foam padding on the side facing the user. In another embodiment, the support base 222 may have a shape such as a convex profile. Support base 222 has one or more through holes 254 configured to receive mounting bolts or the like to facilitate the attachment of additional materials to support base 222.

In embodiments, the mechanical extender 228 includes an electric motor. In other embodiments, the mechanical extender 228 may be activated through pneumatic means. In other embodiments, the mechanical extender 228 may be mechanical means powered by the user such as a rotating knob.

Figure 4:
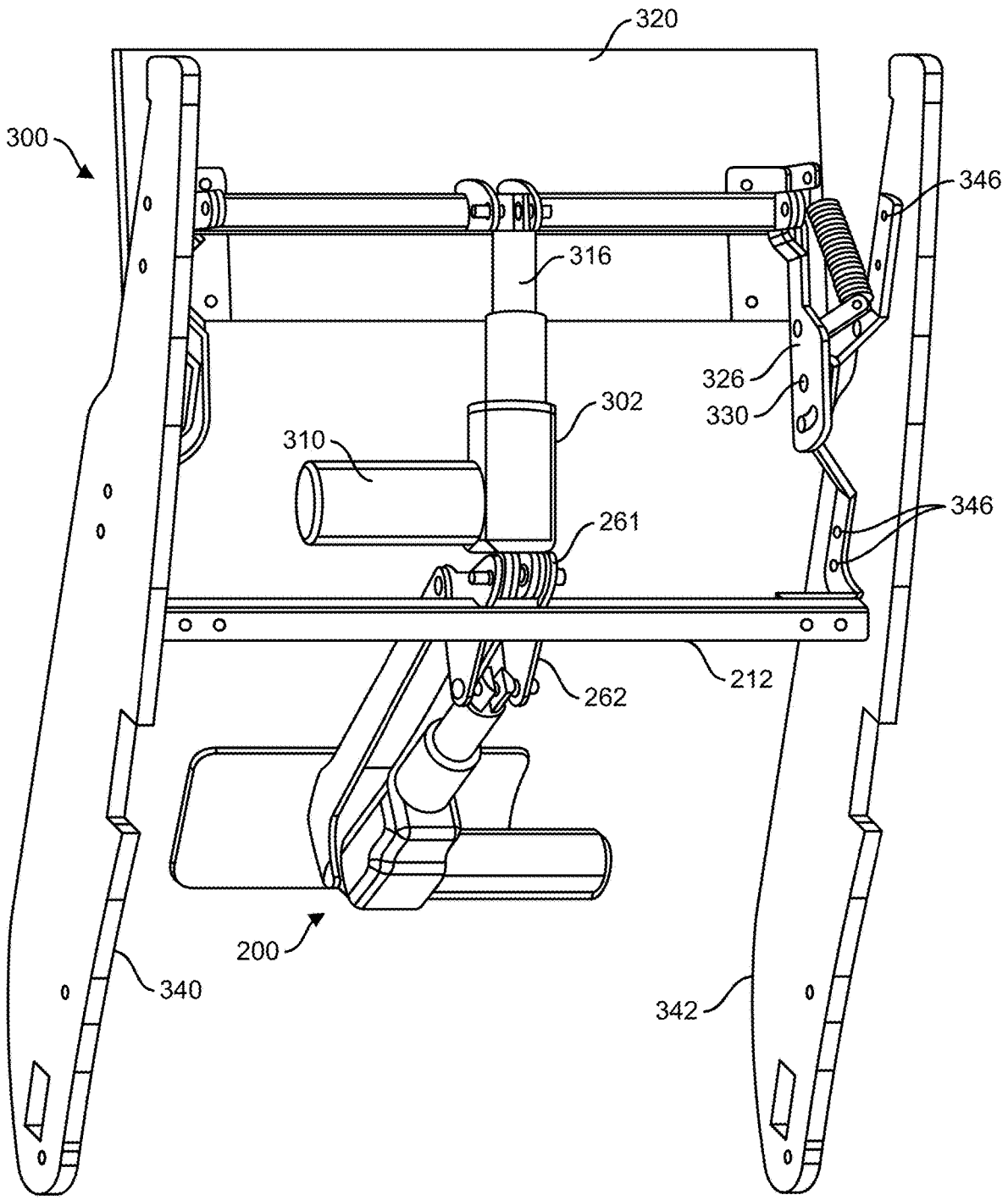
FIG. 4 is a perspective view of an adjustable lumbar mechanism attached to a cross bar and a head rest tilt mechanism attached to the same cross bar.

Referring to FIG. 4, in an embodiment, the cross bar 212 also supports a head rest tilt mechanism 300. The head rest tilt mechanism has an actuator 302, with a motor 310 and a telescoping arm 316. User actuation moves the arm inwardly and outwardly causing the head rest base 320 and attached brackets 326 to rotate about pivot pins 330. The actuator is pinned to a lobe 261 of bracket 262. The cross bar 212 and head tilt mechanism 300 are secured to the frame members 340, 342 by screws 346, rivets, or other fasteners.

The following patents and publications are incorporated herein for all purposes: U.S. Pat. Nos. 10,306,986; 9,826,841; 9,675,178; 8,702,173; 8,622,468; 7,578,797; 6,402,246 and U.S. Pat. Publications 20180064254; 20160367033; 20130145553; 20090079245.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. An adjustable lumbar support system for altering the position of a lumbar support in a piece of furniture having a seat back with a seat back frame having a left side, a right side, a front side, and a back side, the lumbar support system comprising:

a cross bar secured to the seat back frame and extending between the left and right sides of the seat back frame;

a bracket system having two or more pivot points, wherein the bracket system is mounted to a central portion of the cross bar;

a lumbar support base having a front surface, the front surface facing the front side of the seat back frame;

a single swing arm having an "L" shape, a top portion pivotally coupled to a first pivot point of the bracket system, and a bottom portion fixedly attached to the lumbar support base; and an actuator system having an extendable arm, the actuator system having a first end portion opposite a second end portion, the first end portion pivotally coupled to a second pivot point of the bracket system and the second portion pivotally coupled to the bottom portion of the single swing arm, wherein extending the extendable arm of the actuator system pushes the lumbar support base towards the front side of the seat back frame, and wherein the bottom portion of the single swing arm comprises one or more lower knuckles having a connecting portion extending towards the back side of the seat back frame, and wherein a lower pin passing through the one or more lower knuckles and the second portion of the actuator system defines a lower axis of rotation, the lower axis of rotation being generally parallel to the cross bar.

2. The adjustable lumbar support system of claim 1, wherein the top portion of the single swing arm comprises one or more knuckles.

3. The adjustable lumbar support system of claim 2, wherein a pin passing through the one or more knuckles and the bracket system defines an axis about which the single swing arm rotates.

4. The adjustable lumbar support system of claim 1, wherein the bracket system comprises a pair of brackets.

5. The adjustable lumbar support system of claim 4, wherein each of the pair of brackets define a notch generally conforming to the cross bar, the brackets welded thereto.

6. An adjustable lumbar support system for altering the position of a lumbar support in a piece of furniture having a seat back with a seat back frame having a left side, a right side, a front side, and a back side, the lumbar support system comprising:

a cross bar secured to the seat back frame and extending between the left and right sides of the seat back frame;

a bracket system having two or more pivot points, wherein the bracket system is mounted to a central portion of the cross bar;

a lumbar support base having a front surface, the front surface facing the front side of the seat back frame;

a single swing arm having an "L" shape, a top portion pivotally coupled to a first pivot point of the bracket system, and a bottom portion fixedly attached to the lumbar support base; and an actuator system having an extendable arm, the actuator system having a first end portion opposite a second end portion, the first end portion pivotally coupled to a second pivot point of the bracket system and the second portion pivotally coupled to the bottom portion of the single swing arm, wherein extending the extendable arm of the actuator system pushes the lumbar support base towards the front side of the seat back frame, wherein the bracket system comprises a pair of brackets, and wherein each of the pair of brackets comprises a stop limiting the rotation of the single swing arm towards the back side of the seat back frame.

7. The adjustable lumbar support system claim 4, wherein the pair of brackets are spaced apart such that a pair of knuckles can surround the pair of brackets and the first end portion of the actuator system fits within the pair of brackets.

8. The adjustable lumbar support system of claim 7, wherein a first pin passes through the each of the pair of and knuckles and the pair of brackets at a first of the two or more pivot points, and a second pin passes through the first end portion of the actuator system and the pair of brackets.

9. The adjustable lumbar support system of claim 8, wherein the first pin is farther from the back side of the seat back frame than the cross bar, and the second pin is generally the same distance from the back side of the seat back frame as the cross bar.

10. The adjustable lumbar support system of claim 1, wherein the one or more lower knuckles comprises a mounting portion opposite the connecting portion.

11. The adjustable lumbar support system of claim 10, wherein the mounting portion of the one or more lower knuckles defines one or more notches configured to interface with corresponding slots in the lumbar support base such that support base is generally flush with the single swing arm when mounted.

12. The adjustable lumbar support system of claim 1, wherein the support base is welded to the single swing arm.

13. The adjustable lumbar support system of claim 1, wherein the support base defines a plurality of through holes configured to receive mounting bolts.

14. The adjustable lumbar support system of claim 1, wherein the actuator system is motorized.

15. The adjustable lumbar support system of claim 14, wherein a motor fits within the seat back frame.

16. A seating unit for providing adjustable lower spine support comprising:

a seat back extending upwardly from a seat base, the seat back comprising a seat back frame having a right side, a left side, a front side facing the seat base, and a rear side opposite the front side; and a lumbar support system configured to adjust the position of a lumbar support base, the lumbar support system comprising:

a cross bar extending between the left and right sides of the seat back frame;

a pair of brackets mounted to the cross bar, each of the pair of brackets having first and second pivot points, wherein each of the pair of brackets comprises a stop limiting the rotation of the single swing arm towards the back side of the seat back frame;

a single swing arm pivotally coupled the first pivot point of each of the pair of brackets, and a bottom portion fixedly attached to the lumbar support base; and an actuator system having an extendable shaft and a mechanical extender, the actuator system having a first end portion opposite a second end portion, the first end portion pivotally coupled to the second pivot point of each of the pair of brackets and the second portion pivotally coupled to the bottom portion of the single swing arm, wherein extending the extendable shaft of the actuator system pushes the lumbar support base towards the front side of the seat back frame.

17. The seating unit of claim 16, wherein the mechanical extender is motorized.

18. The seating unit of claim 16, wherein the cross bar is a metal tube.

* * * * *